United States Patent [19]

Koizumi et al.

[11] 3,938,375

[45] Feb. 17, 1976

[54] PROCESS AND APPARATUS FOR ROLLING FORMING A CYLINDRICAL MEMBER HAVING A REDUCED DIAMETER PORTION AT ITS INTERMEDIATE PORTION

[75] Inventors: Mokuji Koizumi; Yukitsugu Kobayashi; Hidehiko Tsukamoto; Nobutaka Maeda, all of Hiroshima, Japan

[73] Assignee: Mitsubishi Jukogyo Kabushiki Kaisha, Tokyo, Japan

[22] Filed: Jan. 15, 1974

[21] Appl. No.: 433,562

[30] Foreign Application Priority Data

Dec. 18, 1972 Japan ..... 47-126184

[52] U.S. Cl. ..... 72/108; 72/71

[51] Int. Cl.[2] ..... B21H 1/00

[58] Field of Search ..... 72/71, 102, 108, 469

[56] References Cited

UNITED STATES PATENTS

| | | | |
|---|---|---|---|
| 3,208,257 | 9/1965 | Holub | 72/108 |
| 3,352,138 | 11/1967 | Haug | 72/76 |
| 3,466,910 | 9/1969 | Carlsen | 72/71 |
| 3,626,733 | 12/1971 | Zook et al. | 72/104 |

*Primary Examiner*—Lowell A. Larson

*Attorney, Agent, or Firm*—Cushman, Darby & Cushman

[57] ABSTRACT

A process and apparatus for rollingly forming a cylindrical member having a reduced diameter portion at its intermediate portion by using a cross-rolling forming apparatus. The width in cross-section each of the dies in the rolls of the apparatus is gradually varied or decreased as the working of the member advances by providing clearance surfaces in the beveled side surfaces of the dies at an appropriate escape angle so that the surfaces in the member which have been worked by the dies are held clear of the side surfaces of the dies.

2 Claims, 9 Drawing Figures

PROCESS AND APPARATUS FOR ROLLING FORMING A CYLINDRICAL MEMBER HAVING A REDUCED DIAMETER PORTION AT ITS INTERMEDIATE PORTION

BACKGROUND OF THE INVENTION

This invention relates to a process and apparatus for special forming of a member in a cross-rolling forming process.

In the prior art cross-rolling forming process for forming a cylindrical member having a reduced diameter cylindrical portion at its intermediate portion connected to the opposite ends of the member by conical surfaces, respectively, the reduction ratio of the diameter of the reduced diameter portion with respect to the large diameter of the opposite ends of the member is limited to a certain value, while the taper angle of the conical surfaces connecting the reduced diameter portion to the opposite ends of the member is necessarily held to be the same as the wedge angle of the beveled side surfaces of the dies secured to the rolls of the apparatus, thereby giving severe restriction to the capability of the rolling forming operation.

This invention aims at avoiding the above described disadvantages of the prior art cross-rolling forming process.

SUMMARY OF THE INVENTION

It is the object of this invention to provide a process and apparatus for rollingly forming a cylindrical member having a reduced diameter portion at its intermediate portion connected to the opposite ends of the member of large diameter by conical surfaces wherein the above described restriction in the capability of the rolling forming operation is eliminated and the reduction ratio of the diameter is widely improved while the taper angle of the conical surfaces connecting the reduced diameter portion to the opposite ends of the member can be freely selected without being limited by the wedge angle of the beveled side surfaces of the dies of the rolls.

The above object is achieved in accordance with the characteristic feature of this invention by varying or reducing the width in cross-section of the beveled side surfaces of the dies in the rolls as the rolling forming operation advances by forming clearance surfaces of an appropriate escape angle in the beveled side surfaces so that portions of the conical surfaces which have been formed by the preceding portions of the beveled side surfaces are made clear of the remaining portions of the side surfaces as the rolling forming operation proceeds, while the reduction ratio of the diameter is increasingly improved by virtue of the fact that the already formed portions of the conical surfaces are not contacted with the beveled side surfaces of the dies thereby preventing the already formed conical surfaces from being further worked.

DETAILED DESCRIPTION OF THE PREFERRED EMBODIMENT

Prior to the description of this invention, the rolling forming operation by the prior art cross-rolling forming apparatus will be described with reference to FIGS. 1 – 6*a*, 6*b*, 6*c* and 6*d* for the better understanding of this invention.

Figure 1:
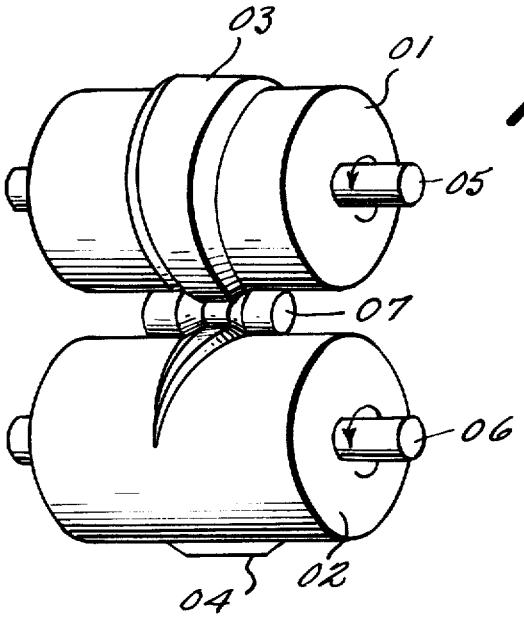
Fig. 1 PRIOR ART
FIG. 1 is a perspective view showing the process for rolling forming by using the prior art cross-rolling forming apparatus.
Figure 2:
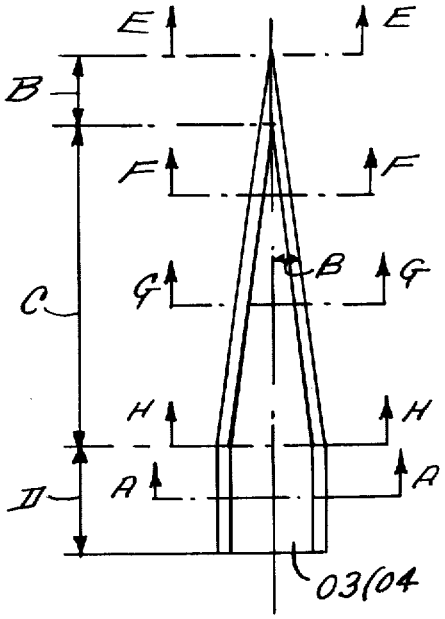
Fig. 2 PRIOR ART
FIG. 2 is a diagram showing the developed configuration of one of the forming dies used in the rolls shown in FIG. 1.

Referring now to FIGS. 1 and 2, a pair of rolls 01,02 are supported by roll shafts 05,06 in parallel to each other and driven in the same direction as indicated by the arrows in FIG. 1. The rolls 01,02 are provided at their outer peripheral surfaces with forming dies 03,04, respectively. A cylindrical member 07 to be worked is inserted between the rolls 01,02 so that the member 07 is rotated by the rolls 01,02 and, during the rotation, the member 07 is worked by the dies 03,04 thereby achieving the rolling forming operation to the member 07.

Figure 3:
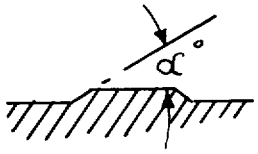
Fig. 3 PRIOR ART
FIG. 3 is a cross-sectional view taken along line A—A in FIG. 2.

Referring to FIGS. 2 and 3, each of the standard dies 03,04 shown comprises a bite portion B for first forming a depression in the member 07, a depression spreading portion C for widening the width of the depressed portion in the member 07 according to the advance angle $\beta$ of the dies 03,04 as the rolls 01,02 rotate, and a finishing portion D for forming the member 07 in the final configuration.

As shown in FIG. 3, each of the dies 03,04 has a flat top surface with the width thereof being continuously increased according to the advance angle $\beta$ along the peripheral direction of the roll 01,02 and opposite beveled side surfaces of the wedge angle of $\alpha$ connecting the top surface to the peripheral surface of the roll. The wedge angle $\alpha$ has influence on the tensile force given to the member to be worked.

In the cross-rolling operation, the value of the wedge angle $\alpha$ and the value of the advance angle $\beta$ are very important factors and the prior art standard rolling forming process and various publications show the following relationships:

If $\alpha \leqslant 15°$, the member to be worked tends to be made in the eliptical form.

If $20° \leqslant \alpha \leqslant 30°$, superior rolling forming operation of the member can be carried out.

If $30° \leqslant \alpha \leqslant 60°$, circumferential depressions tend to be formed in the worked member or the reduced diameter portion tends to be broken.

If $70° \leqslant \alpha$, slip between the dies the member to be worked will take place thereby making it almost impossible to carry out proper rolling forming operation.

If $5° \leq \beta \leq 10°$, superior rolling forming operation of the member is achieved.

Technically, in general, the range of $\alpha = 10° - 45°$ is said to be the range in which the rolling forming operation is practically possible.

As the value of $\alpha$ is reduced, a hole tends to be formed at the center of the member by the Mannesmann effect, however, the axial tensile force given to the member is reduced thereby reducing the possibility of breakage of the reduced diameter portion of the member.

To the contrary, as the value of $\alpha$ is increased, tensile force given to the member is increased thereby tending to cause the reduced diameter portion of the member to be broken.

Figure 4:
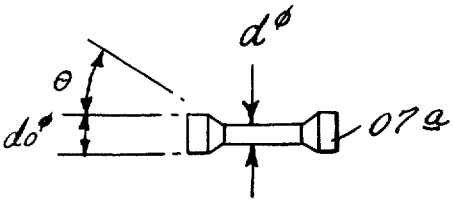
Fig. 4 PRIOR ART
FIG. 4 is a general side view showing the configuration of the cylindrical member having the reduced diameter portion at its intermediate portion formed by the cross-rolling forming operation.
Figure 5:
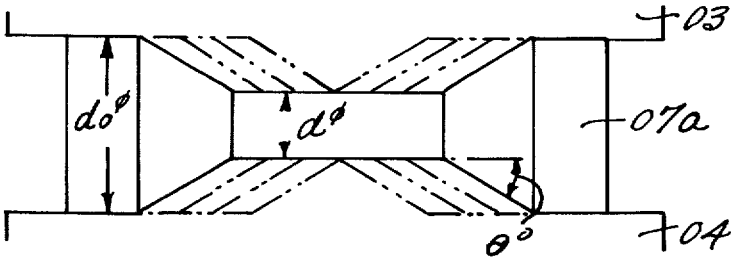
Fig. 5 PRIOR ART
FIG. 5 is a diagram showing the procedure in the rolling forming operation of the prior art.
Figure 6:
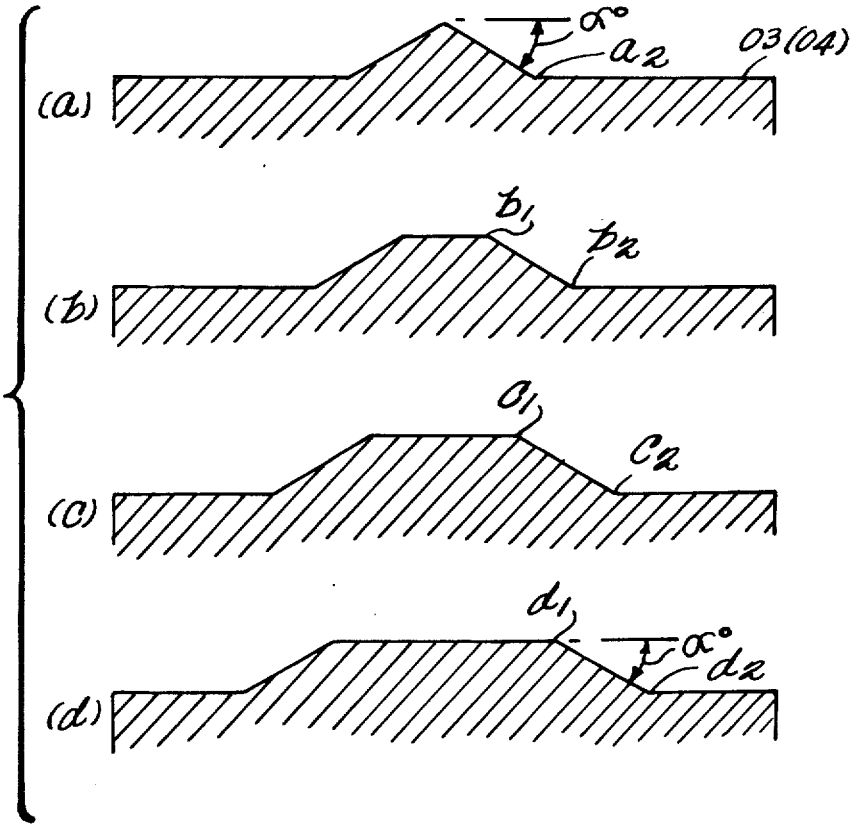
Fig. 6 PRIOR ART
FIGS. 6*a*, 6*b*, 6*c* and 6*d* are cross-sectional views respectively along lines E—E, F—F, G—G, and H—H in FIG. 2.

Under the circumstances as described above, the reduction ratio of diameter $d/d_o$ during the rolling forming operation ($d_o$ = large outer diameter of the opposite ends of the formed member, $d$ = diameter of the reduced diameter portion of the member, FIG. 4) is generally said to be $0.6 < d/d_o < 0.85$, and, by appropriately selecting the value of $\beta$, the reduction ratio $d/d_o$ is said to be able to be reduced to $d/d_o = 0.5$. However, the rolling forming operation is practically very difficult under such a reduced reduction ratio of $d/d_o = 0.5$.

Further, as the reduction ratio $= d/d_o$ is made small, the area of the beveled side surfaces of the dies are made larger regardless of the value of $\alpha$, thereby increasing the axial tensile force so that the reduced diameter portion of the member tends to be broken. Thus, the reduction ratio $d/d_o$ is necessarily restricted from the above viewpoint.

Referring now to FIG. 5 and FIGS. 6*a*, 6*b*, 6*c* and 6*d*, the rolling forming operation by the standard dies is effected by the beveled side surfaces $\overline{a_1a_2}$, $\overline{b_1b_2}$, $\overline{c_1c_2}$ and $\overline{d_1-d_2}$ having the wedge angle of $\alpha$ wherein the beveled side surfaces are compressively contacted with the surfaces of the member to be worked, therefore, the taper angle $\theta$ of the conical surfaces of the member 07*a* necessarily coincides with the wedge angle $\alpha$, i.e., $\alpha = \theta$.

In the prior art rolling forming operation as described above, it is impossible to carry out the rolling forming operation in which $\alpha \neq \theta$, thereby giving severe restriction to the capability of the rolling forming operation of the prior art.

This invention eliminates the above described disadvantages of the prior art and makes it possible to largely widen the capability of the rolling forming operation while the rolling forming operation can be carried out under the conditions in which the reduction ratio $d/d_o$ is lowered even below 0.5, i.e., $d/d_o < 0.5$ and the taper angle $\theta$ of the conical surfaces of the member is made different from the wedge angle $\alpha$.

Figure 7:
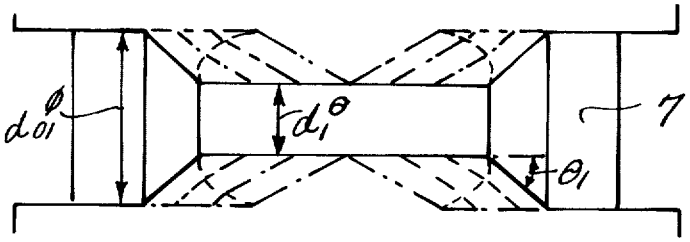
FIG. 7 is a diagram showing the procedure in the rolling forming operation in accordance with this invention.
Figure 8:
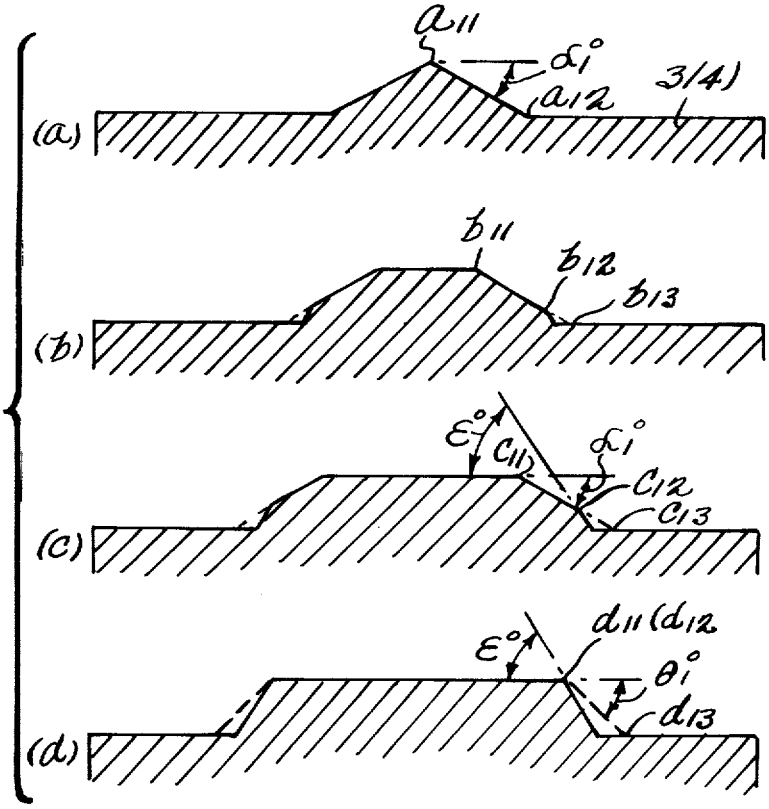
FIGS. 8*a*, 8*b*, 8*c* and 8*d* are cross-sectional views of one of the forming dies respectively corresponding to FIGS. 6*a*, 6*b*, 6*c* and 6*d* but provided in accordance with this invention.
Figure 9:
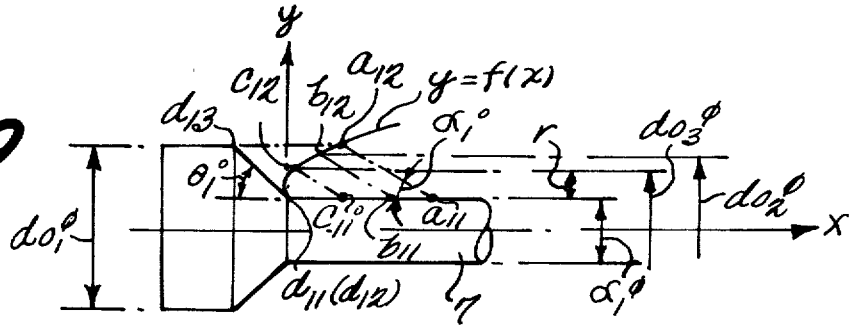
FIG. 9 is a diagram showing in detail the procedure of the rolling forming operation in accordance with this invention.

Referring to FIGS. 7 – 9, the forming dies 3, 4 used in the process of this invention have the wedge angle of $\alpha_1$ and the width in cross-section of the beveled side surfaces is continuously varied or reduced as shown by $\overline{a_{11}a_{12}}$, $\overline{b_{11}b_{12}}$, $\overline{c_{11}c_{12}}$ and $\overline{d_{11}(d_{12})}$ in FIGS. 8*a*, 8*b*, 8*c* and 8*d*, the width of $\overline{d_{11}(d_{12})}$ being converged to a point as shown. In order to provide the above described reduction in the width of the beveled side surfaces, clearance surfaces are formed in the beveled side surfaces at an appropriate escape angle $\epsilon$ so that the rolling forming operation is not effected by the clearance surfaces, i.e., the rolling forming operation is effected only by the varying beveled side surfaces $\overline{a_{11}a_{12}}$, $\overline{b_{11}b_{12}}$, $\overline{c_{11}c_{12}}$ and $\overline{d_{11}(d_{12})}$.

When the dies 3, 4 constructed as described above are attached to the rolls in a cross-rolling forming apparatus, the depressed portion of the member to be worked is widened in its width by the beveled side surfaces and, since the width in cross-section of the beveled side surfaces $\overline{a_{11}a_{12}}$, $\overline{b_{11}b_{12}}$, $\overline{c_{11}c_{12}}$ and $\overline{d_{11}(d_{12})}$ varies or decreases continuously to converge into a point $d_{11}$ with the clearance surfaces having the escape angle $\Delta$ being continuously increased so as to be cleared from the worked surface of the member, the portions of the surfaces of the member cleared from the beveled side surfaces remain in a predetermined configuration which is determined by the rate of variation in the width in cross-section of the beveled side surfaces of the dies 3, 4. Such surfaces are referred to hereinafter as self-generating surfaces.

FIGS. 8*b*, 8*c* and 8*d* show the portions of the self-generating surfaces such as $\overline{b_{12}b_{13}}$, $\overline{c_{12}c_{13}}$ and $\overline{d_{11}d_{13}}$ during the rolling forming operation using the dies of this invention. The angle $\theta_1$ of the final self-generating surfaces $\overline{d_{11}d_{13}}$ is the taper angle of the conical surfaces connecting the reduced diameter portion to the opposite ends of the member finally worked as shown in FIGS. 7 and 9.

The rate of variation in the width of the beveled side surfaces for obtaining the desired self-generating surfaces, i.e., $y = f(x)$ (FIG. 9), can be determined by repeating the try and search method, but it is also determined theoretically by the volumetric calculation of the material to be worked.

The above described process is always possible insofar as $\alpha_1 \leq \theta$.

In the rolling forming operation in accordance with this invention, the actual reduction ratio of diameter is continuously increased as shown by $d_1/d_{o1}$, $d_1/d_{o2}$ and $d_1/d_{o3}$ in FIG. 9 as the rolling forming advances. Therefore, excessively large tensile force given to the member by the beveled side surfaces of the dies is avoided thereby preventing the reduced diameter portion of the member from being formed with circumferential depressions or from being broken. Therefore, in accordance with this invention, it is made possible to work a member at a very low value of reduction ratio $d_1/d_o$ such as below 0.5, thereby permitting the capability of rolling forming operation to be largely increased in accordance with this invention.

We claim:

1. In apparatus for rolling forming a cylindrical member having a reduced diameter cylindrical portion at its intermediate portion connected to the opposite ends of said member by conical surfaces by using a cross-rolling forming apparatus in which a pair of rolls are arranged in parallel to each other with a clearance held therebetween for locating the member to be worked therein and driven in the same rotational direction with each other, said rolls being provided with forming dies cooperating with each other each having a top surface and beveled side surfaces extending in the circumferential direction of the respective roll with the width in cross-section of the respective top surfaces cooperating with each other being continuously increased as said rolls rotate, so that said reduced diameter cylindrical portion and said conical surfaces are formed in said cylindrical member by said dies when said cylindrical member is inserted between said rolls so as to be worked thereby, the improvement wherein the width in cross-section each of said beveled side surfaces of said dies is gradually reduced by providing a clearance surface formed in the respective beveled side surface at an appropriate escape angle, thereby permitting the portion of each of said conical surfaces having been formed by the preceding portions of said beveled side surfaces of said dies to be clear of the remaining portions of said beveled side surface of said dies as said rolls rotate so that the reduction ratio of diameter during the working of said member is increased to facilitate the working although the resultant reduction ratio of diameter as a whole can be made low while the taper angle of said conical surfaces of said member can be varied from the wedge angle of said beveled side surfaces of said die.

2. A process for cross-rolling a cylindrical member to provide the member with an axially intermediate exterior surface portion of reduced diameter connected to opposite end portions by circumferentially extending frustoconical transitional surfaces, comprising:

rolling the cylindrical member between a pair of rolls arranged in parallel to each other with a clearance held therebetween for locating the member to be worked therein and driving the rolls in the same rotational direction with each other, said rolls having forming dies cooperating with each other, each having a top surface and beveled side surfaces extending in the circumferential direction of the respective roll with the width in cross-section of the respective top surfaces cooperating with each other being continuously increased as said rolls rotate, so that said reduced diameter cylindrical portion and said frusto-conical surfaces are formed in said cylindrical member by said dies when said cylindrical member is worked by being rolled between said rolls, the width in cross-section each of said beveled side surfaces of said dies gradually reducing angularly of the rolls due to the provision of clearance surfaces formed in the respective beveled side surfaces at an appropriate escape angle; the portion of each of said frusto-conical surfaces formed by the angularly preceding portions of said beveled side surfaces of said dies clearing the angularly succeeding portions of said beveled side surfaces of said dies as said rolls rotate, whereby the reduction ratio of diameter during the working of said member is increased to facilitate the working although the resultant reduction ratio of diameter as a whole can be made low while the taper angle of said conical surfaces of said member can be varied from the wedge angle of said beveled side surfaces of said die.

* * * * *